US006799988B2

(12) United States Patent
Mansur

(10) Patent No.: US 6,799,988 B2
(45) Date of Patent: Oct. 5, 2004

(54) INSULATION DISPLACEMENT ELECTRICAL CONNECTOR WITH SPRING RETAINERS

(75) Inventor: Philip R. Mansur, Bothell, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/303,218

(22) Filed: Nov. 25, 2002

(65) Prior Publication Data

US 2003/0077934 A1 Apr. 24, 2003

Related U.S. Application Data

(63) Continuation-in-part of application No. 10/288,384, filed on Nov. 4, 2002, now Pat. No. 6,626,694, which is a continuation of application No. 09/905,746, filed on Jul. 12, 2001, now Pat. No. 6,475,019.

(51) Int. Cl.[7] ..... H01R 4/24; H01R 4/26; H01R 11/20; H01R 13/40

(52) U.S. Cl. ..... 439/404; 439/595

(58) Field of Search ..... 439/404, 595, 439/603, 402, 403, 536, 701, 725

(56) References Cited

U.S. PATENT DOCUMENTS

| | | | | |
|---|---|---|---|---|
| 3,496,522 | A | 2/1970 | Ellis, Jr. et al. | 339/99 |
| 3,611,264 | A | 10/1971 | Ellis, Jr. | 339/99 |
| 4,059,331 | A | 11/1977 | Sedlacek et al. | 339/198 R |
| 4,106,837 | A | 8/1978 | Paluch | 339/98 |
| 4,869,685 | A | 9/1989 | Olsson | 439/404 |
| 4,964,812 | A | 10/1990 | Siemon et al. | 439/403 |
| 5,409,404 | A | 4/1995 | Reed | 439/736 |
| 5,496,191 | A | 3/1996 | Johnston | 439/404 |
| 5,591,045 | A | 1/1997 | Pepe et al. | 439/460 |
| 5,624,267 | A | 4/1997 | Johnston | 439/54 |
| 5,645,445 | A | 7/1997 | Siemon et al. | 439/395 |
| 5,711,067 | A | 1/1998 | Jenner et al. | 29/874 |
| 5,722,850 | A | 3/1998 | White | 439/404 |
| D408,013 | S | 4/1999 | Zimmer et al. | D13/147 |
| 5,893,763 | A | 4/1999 | O'Connor et al. | 439/76.1 |
| 5,897,383 | A | 4/1999 | Johnston | 439/54 |
| D409,147 | S | 5/1999 | Zimmer et al. | D13/147 |
| 6,007,368 | A | 12/1999 | Lorenz et al. | 439/418 |
| 6,050,842 | A | 4/2000 | Ferrill et al. | 439/404 |
| 6,056,584 | A | 5/2000 | Daoud | 439/403 |
| 6,086,407 | A | 7/2000 | Daoud | 439/405 |
| 6,135,821 | A | 10/2000 | Liu | 439/676 |
| 6,213,809 | B1 | 4/2001 | Viklund | 439/418 |
| 6,475,019 | B1 * | 11/2002 | Zielke et al. | 439/404 |
| 6,626,694 | B2 * | 9/2003 | Zielke et al. | 439/404 |

* cited by examiner

*Primary Examiner*—Chandrika Prasad
(74) *Attorney, Agent, or Firm*—George C. Rondeau, Jr.; Davis Wright Tremaine LLP

(57) ABSTRACT

An electrical connector having a body with a plurality of contact cavities therein with an open end, and a plurality of insulation penetrating beam contacts received within the cavities. Each contact has a first end portion to engage a wire and a second portion with a protrusion. The connector also includes a plurality of spring arms and stops positioned adjacent to the contact cavities. Each arm has a resiliently movable free end portion positioned to releasably engage the protrusion when the contact is in the contact cavity at which the spring arm is positioned. The end portion of each arm and the stop for each contact cavity are spaced apart to receive the contact protrusion therebetween. The arm is resiliently movable to permit insertion and removal of the contact through the open end.

44 Claims, 8 Drawing Sheets

INSULATION DISPLACEMENT ELECTRICAL CONNECTOR WITH SPRING RETAINERS

CROSS-REFERENCE TO RELATED APPLICATION

This application is a continuation-in-part of U.S. patent application Ser. No. 10/288,384, filed Nov. 4, 2002, now U.S. Pat. No. 6,626,694, which is a continuation of U.S. patent application Ser. No. 09/905,746, filed Jul. 12, 2001, and issued Nov. 5, 2002, as U.S. Pat. No. 6,475,019, which applications are incorporated herein by reference in their entirety.

BACKGROUND OF THE INVENTION

The 110-style connector is frequently used in the telephone industry to electrically interconnect a set of first conductors such as insulated wires to a set of second conductors such as conductive paths on a printed circuit board or a second set of insulated wires. The connector includes a dielectric body and a plurality of slotted beam insulation displacement contacts retained within the body. In use, one or more insulated wires are positioned with one insulated wire above each slotted beam contact. A force is applied to press each insulated wire into a slot of the corresponding slotted beam contact. The slotted beam contact cuts through the insulation and grasps the metal wire therein thereby making good electrical contact with the wire. The slotted beam contact may have such slots at both ends of the contact. The body is usually made of a plastic material.

When manufacturing the 110-style connector, each slotted beam contact is inserted into a cavity in the plastic body and must be retained therein to prevent dislodgement during use and handling, preferably allowing minimum movement of the contact within the body cavity. Holding the slotted beam contacts securely within the body cavity can be a particular problem because of the large force required to press the insulated wires into the slots of the slotted beam contacts. If the slotted beam contacts can move too much within the body cavity once inserted and secured therein, their movement can make difficult alignment of the wires with the slots of the contacts.

In the past, the slotted beam contacts have been held within their body cavities by various means. For example, in U.S. Pat. Nos. 4,964,812 and 5,645,445, the slotted beam contact and the body each have an opening. Once the slotted beam contact is within the body cavity, a pin is inserted in the aligned contact and body openings to hold the contact in place. This must be done for each slotted beam contact and involves an extra part and manufacturing step, thus increasing the cost of manufacturing the connector. Further, the pin allows the slotted beam contact to move within the body cavity more than desirable.

In U.S. Pat. No. 5,409,404, the body cavity for each slotted beam contact has a thin walled section that is engaged with a tool after the contact is in the body cavity to sever three sides of the wall section and bend it into engagement with the contact to hold the contact within the body cavity. Again, this involves an extra step and increases cost.

In U.S. Pat. No. 5,711,067, each slotted beam contact has a tab portion that is bent using a punch tool after the contact is inserted into the body cavity to engage the tab portion with the body to retain the contact within the body cavity. This also involves an extra step and increases cost, and the contact still may move within the body cavity more than desired.

In U.S. Pat. No. 3,611,264, each slotted beam contact has a pair of mounting arms that extend into slots in the body when the contact is inserted into the body cavity. Somewhat similarly, in U.S. Pat. Nos. 3,496,522 and 6,050,842, the slotted beam contacts each have a pair of spring tabs that extend into corresponding apertures in the body when the contact is inserted into the body cavity.

In U.S. Pat. No. 6,056,584, each slotted beam contact has a pair of opposed recesses and within the body cavity for the contact there are a pair of protrusions that snap fit into the recesses to hold the contact in place.

In U.S. Pat. No. 4,106,837, each slotted beam contact has a plurality of bosses that deform the plastic walls of the body when the contact is press-fit into the body cavity and thereby grasp the walls to hold the contact in place.

While a variety of manners exist to retain a slotted beam contact within its body cavity, none retain the contact as securely as desired to prevent dislodgement while still allowing quick, easy and inexpensive manufacturing of the connector, using rapid automatic assembly with minimal parts and assembly steps, and allowing minimum movement of the contact within the body cavity.

FIELD OF THE INVENTION

This invention relates to an electrical connector, and in particular, to a wire termination block utilizing a plurality of slotted beam contacts for a 110-style connector.

BRIEF SUMMARY OF THE INVENTION

The present invention is embodied in an electrical connector of the type for electrically interconnecting a first set of insulated wire conductors with a second set of conductors. The connector includes a body having a plurality of contact cavities therein, and a plurality of insulation penetrating beam contacts, each contact received within one of the contact cavities. Each contact has a first end portion and a second portion spaced away from the first end portion. The second portion of each contact has a protrusion or engagement member. The first end portion is configured to displace the insulation and make electrical contact with the wire of one of the insulated wire conductors of the first set of conductors.

The connector also includes a plurality of resilient spring arms. Each spring arm is positioned adjacent to one of the contact cavities, and has a first portion attached to the body and a resiliently movable second portion. The connector has a plurality of stops, each associated with one of the contact cavities and positioned spaced away from the second portion of the spring arm positioned at the contact cavity by a distance sufficient to receive the protrusion of the contact within the contact cavity therebetween. The second portion of the spring arm is configured to engage the protrusion when the contact is in the contact cavity at which the spring arm is positioned to prevent removal of the contact from the contact cavity. In the illustrated embodiment, the first portion of the spring arm is a resilient hinge portion attached to the body and the second portion is a free end portion.

In the illustrated embodiment, one end of the contact cavity is open and is sized to receive the contact therethrough. Further, the spring arm second portion is positioned to contact and be resiliently moved in response to the spring arm second portion engaging the contact by an amount sufficient to permit insertion of the contact into the contact cavity through the open contact insertion end of the cavity. The spring arm second portion engages the contact protrusion when the contact is fully within the contact cavity to limit its movement toward the open contact insertion end. In the illustrated embodiment of the spring arm second portion includes an end wall that engages the contact protrusion to retain the contact in the cavity. The stop engages the contact protrusion to limit its movement in a direction away from the open contact insertion end.

The spring arm second portion is sufficiently resiliently movable to further allow the spring arm second portion to be resiliently moved by an amount sufficient to disengage the contact protrusion from the spring arm second portion to permit the removal of the contact from the contact cavity through the open contact insertion end.

Other features and advantages of the invention will become apparent from the following detailed description, taken in conjunction with the accompanying drawings.

DETAILED DESCRIPTION OF THE INVENTION

Figure 1:
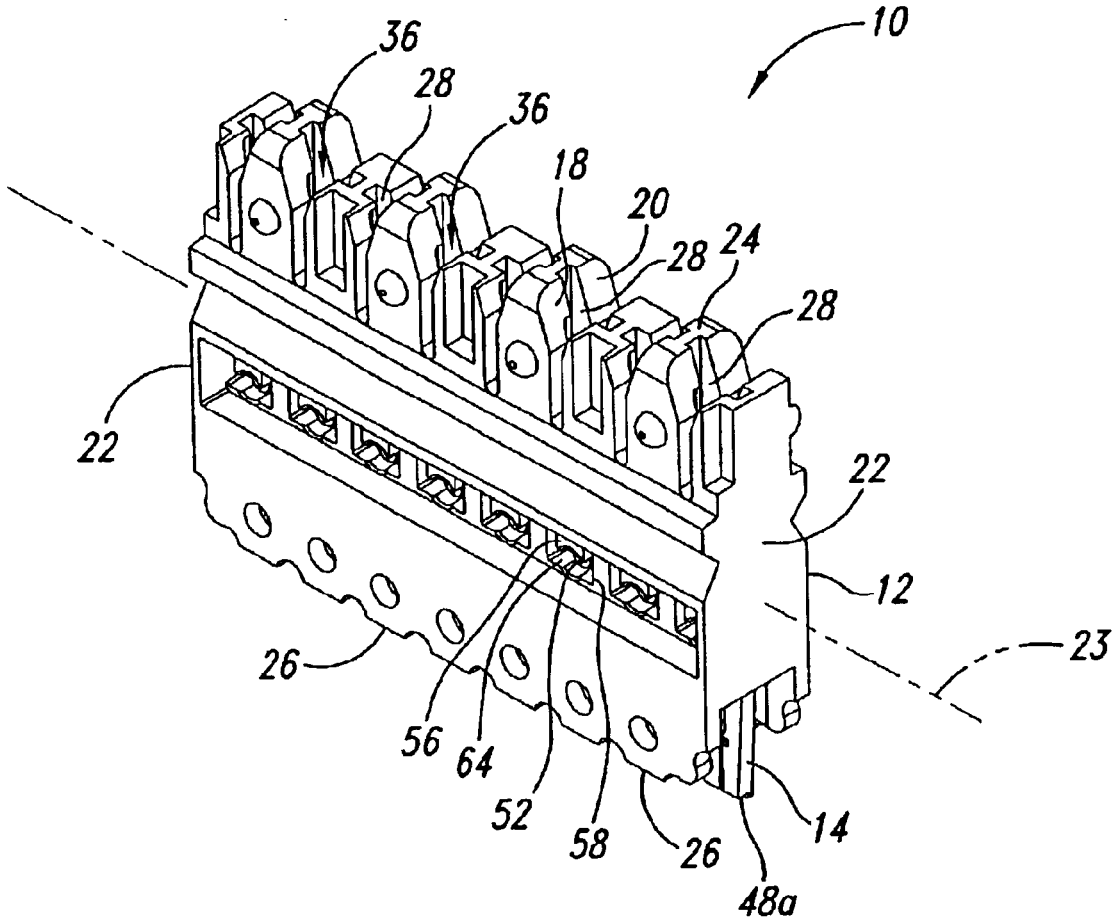
FIG. 1 is an isometric view of an electrical connector embodying the present invention.

An embodiment of an electrical connector 10 of the present invention is illustrated in FIG. 1 fully assembled and ready for use. The connector 10 includes a dielectric housing or body 12 and a plurality of planar slotted beam contacts 14 (only one being clearly visible in FIG. 1). In the illustrated embodiment, eight slotted beam contacts 14 are used, but a fewer or greater number may be used as desired for the connector. The body 12 is typically formed of plastic, and the slotted beam contacts 14 are formed of a plated conductive metal.

Figure 2:
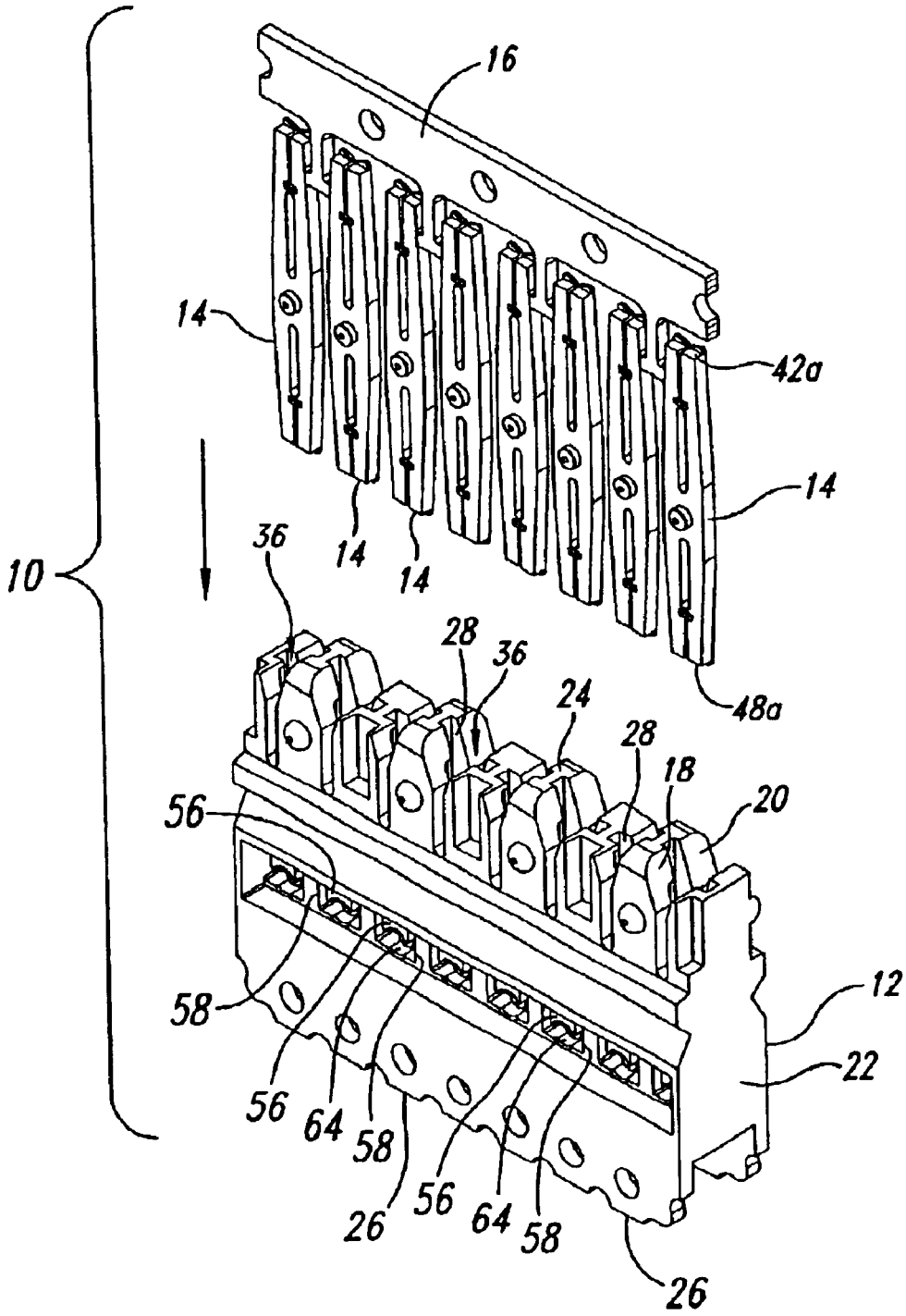
FIG. 2 is an isometric view of the electrical connector body and slotted beam contacts of the electrical connector shown in FIG. 1 with the slotted beam contacts positioned for installation into the body.
Figure 4:
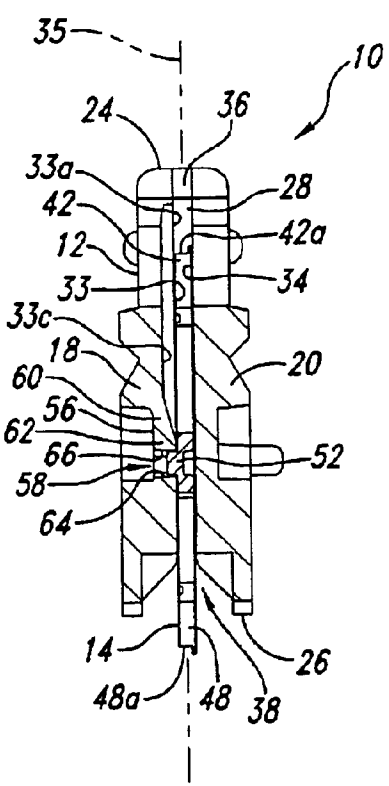
FIG. 4 is a cross-sectional view of the electrical connector taken substantially along line 4—4 of FIG. 3.
Figure 8:
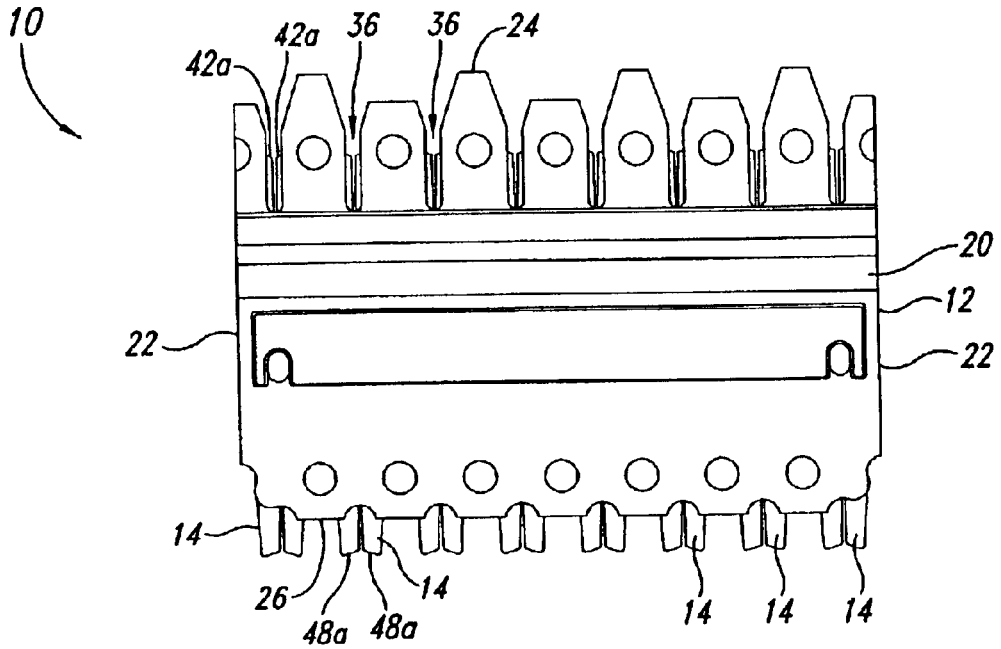
FIG. 8 is a rear elevational view of the electrical connector shown in FIG. 1.
Figure 9:
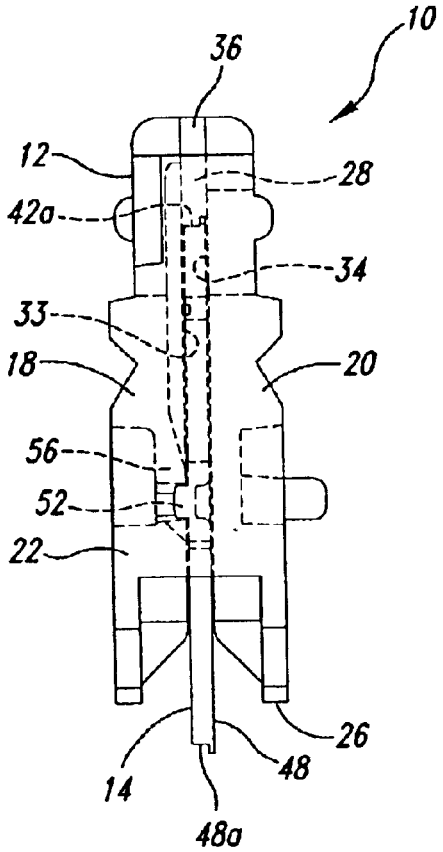
FIG. 9 is a right side elevational view of the electrical connector body of FIG. 1.
Figure 11:
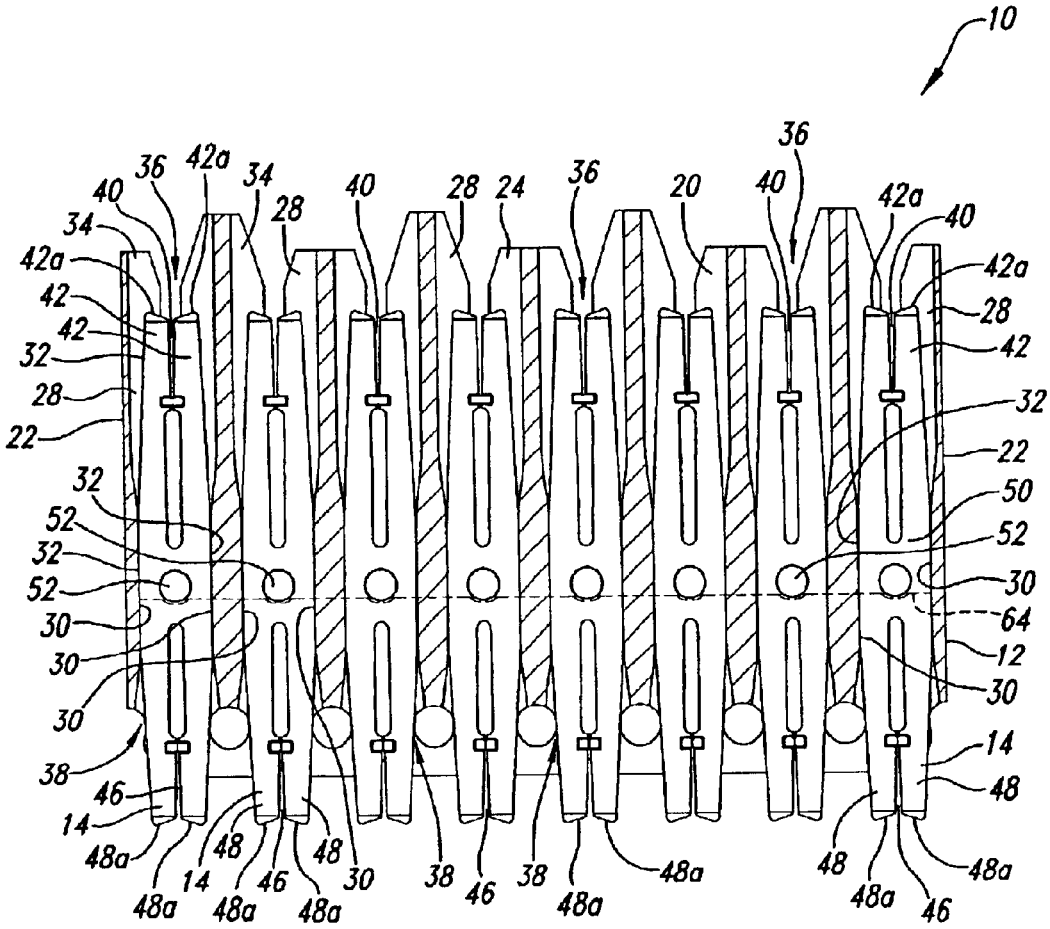
FIG. 11 is a cross-sectional view of the electrical connector taken substantially along line 11—11 of FIG. 10.
Figure 12:
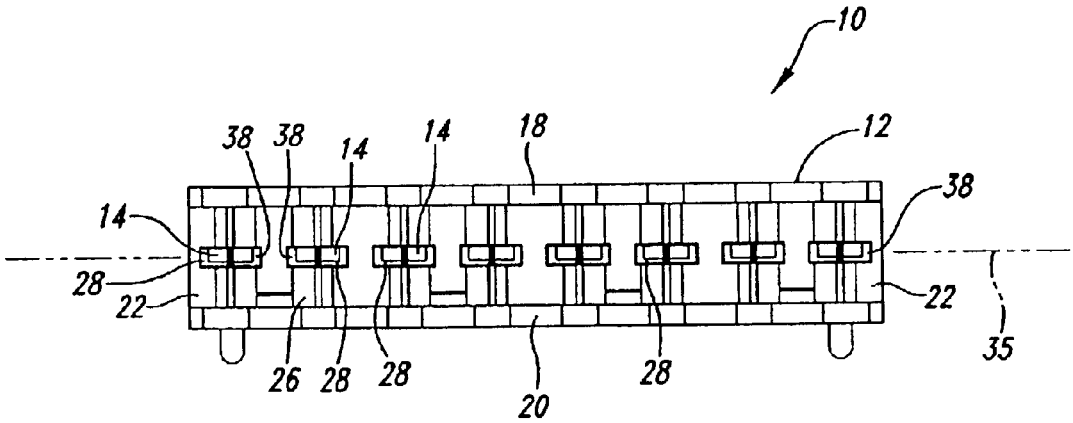
FIG. 12 is a bottom plan view of the electrical connector of FIG. 1.

The body 12 and the slotted beam contacts 14 are shown in FIG. 2 with the contacts separated from the body, in position for insertion into the body. The slotted beam contacts 14 are manufactured as a long leadframe with many contacts connected together by a bar 16 which is cut off after the contacts are inserted into the body 12. As perhaps best shown by FIGS. 3–7 and 11, the body has a front wall 18, a back wall 20 and a pair of left and right end walls 22, with the front and back walls extending along a longitudinal body axis 23 of the body (see FIG. 1). The body 12 further includes a contact loading face 24 and an opposite end face 26 from which the slotted beam contacts 14 extend. Within the body 12, as best illustrated in FIGS. 4 and 11, there are eight elongated body slots or cavities 28, each sized and shaped to receive one of the slotted beam contacts 14. The body 12 is shown in the drawings with the slotted beam contacts 14 positioned within the body cavities 28 and the bar 16 removed except for FIG. 2.

The body cavities 28 each have left and right interior side wall portions 30 (See FIG. 11) shaped and spaced apart to conform to left and right edge wall portions 32 of the slotted beam contact 14 when fully inserted therein and snuggly retain the contact within the body cavity against left to right movements and rotational movements. The interior side wall portions 30 of the body cavities 28 and the edge wall portions 32 of the slotted beam contacts 14 have a substantially perpendicular orientation so that the edge wall portions mate well with the interior side wall portions to provide a good interference fit. Each body cavity 28 also includes a front wall portion 33 and a rear wall portion 34, each having portions spaced apart to receive and snuggly retain the slotted beam contact 14 therebetween. The cavities 28 are arranged in a common plane 35 located between the front and rear wall portions of the cavities (side and top edge views of the common plane being illustrated in FIGS. 4, 5, 10, 12, and 16, as a broken line).

In addition, the body cavities 28 each have an open insertion first end 36 toward the contact loading face 24 of the body 12 sized for insertion of one of the slotted beam contacts 14 into the body cavity, as best shown in FIG. 11. Each body cavity 28 also has as open second end 38 toward the opposite end face 26 of the body 12.

Figure 13:
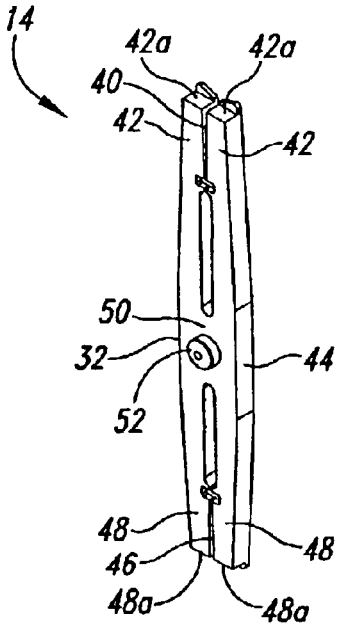
FIG. 13 is an enlarged isometric view on one of the slotted beam contacts used in the electrical connector body of FIG. 1.
Figure 14:
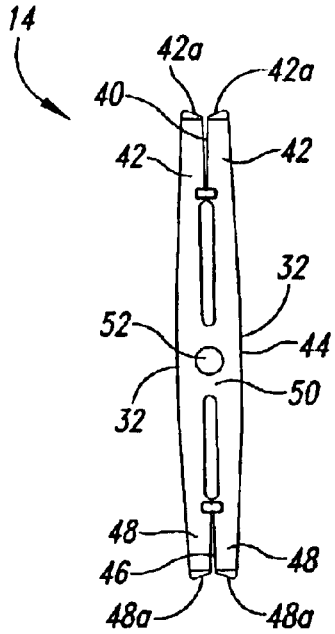
FIG. 14 is front elevational view of the slotted beam contact of FIG. 13.
Figure 15:
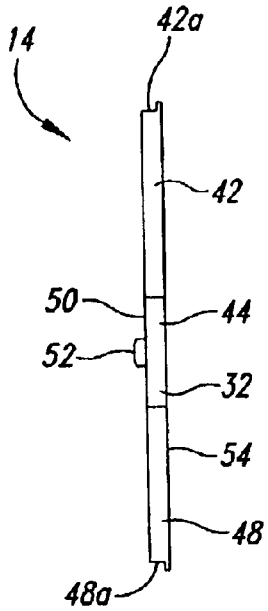
FIG. 15 is a side elevational view of the slotted beam contact of FIG. 13.

One of the slotted beam contacts 14 is illustrated in FIGS. 13–15 separated from the bar 16. Each slotted beam contact 14 includes a first insulation cutting and wire conductor receiving slot 40 formed by a first pair of flat arms 42 extending away from a mid-portion 44 of the contact and terminating at a distal end 42*a*. Each slotted beam contact 14 further includes a second insulation cutting and wire conductor receiving slot 46 formed by a second pair of flat arms 48 extending away from the mid-portion 44 of the contact in an opposite direction and terminating at a distal end 48*a*. The flat arms 42 and 48 are arranged in a common plane.

The first pair of arms 42 of the slotted beam contact 14 are positioned toward the open insertion first end 36 of the body cavity 28, recessed inward of the contact loading face 24 of the body 12. The contact loading face 24 of the body 12 is configured to permit an insulated wire conductor of a first set of insulated wire conductors (not shown) to be pressed into engagement with the distal ends 42*a* of the first pair of arms 42 and moved into the slot 40 between the arms to displace the insulation and cause the slotted beam contact 14 to make electrical contact with the metal wire. The second pair of arms 48 of the slotted beam contact 14 extend from the open second end 38 of the body cavity 28, beyond the opposite end face 26 of the body 12. The opposite end face 26 of the body 12 is configured to permit an insulated wire conductor of a second set of insulated wire conductors (not shown) to be pressed into engagement with the distal ends 48A of the second pair of arms 48 and moved into the slot 46 between the arms to displace the insulation and cause the slotted beam contact 14 to make electrical contact with the metal wire.

The connector 10 of the present invention can also be designed for use when the second set of conductors are conductive traces on a printed circuit board by using a solder terminal for each slotted beam contact 14 that is insertable into a solder hole in the printed circuit board for soldering therein in lieu of the second pair of arms 48.

Projecting forwardly from a flat front face 50 at the mid-portion 44 of the slotted beam contact 14 is a protruding detent or cylindrical boss 52. The slotted beam contact 14 is stamped from a flat rear face 54 to deform the metal of the contact to protrude forwardly and form the boss 52 on the front face 50. As a result, a depression (not shown) is left on the rear face 54 of the mid-portion 44. The slotted beam contacts 14 are die cut from a flat strip of metal to provide a generally flat profile other than the boss 52 stamped therein.

Figure 10:
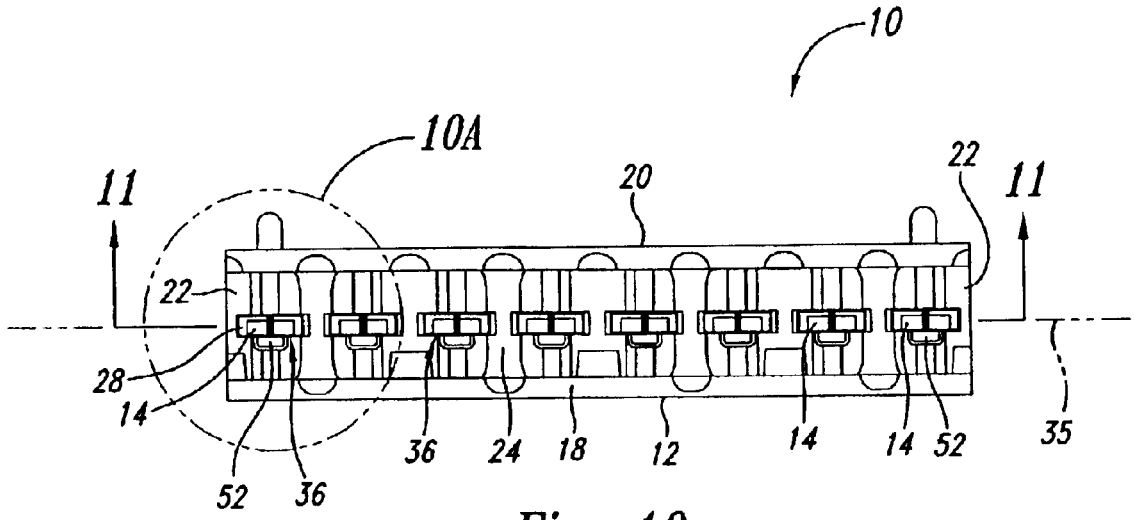
FIG. 10 is a top plan view of the electrical connector of FIG. 1.
Figure 10A:
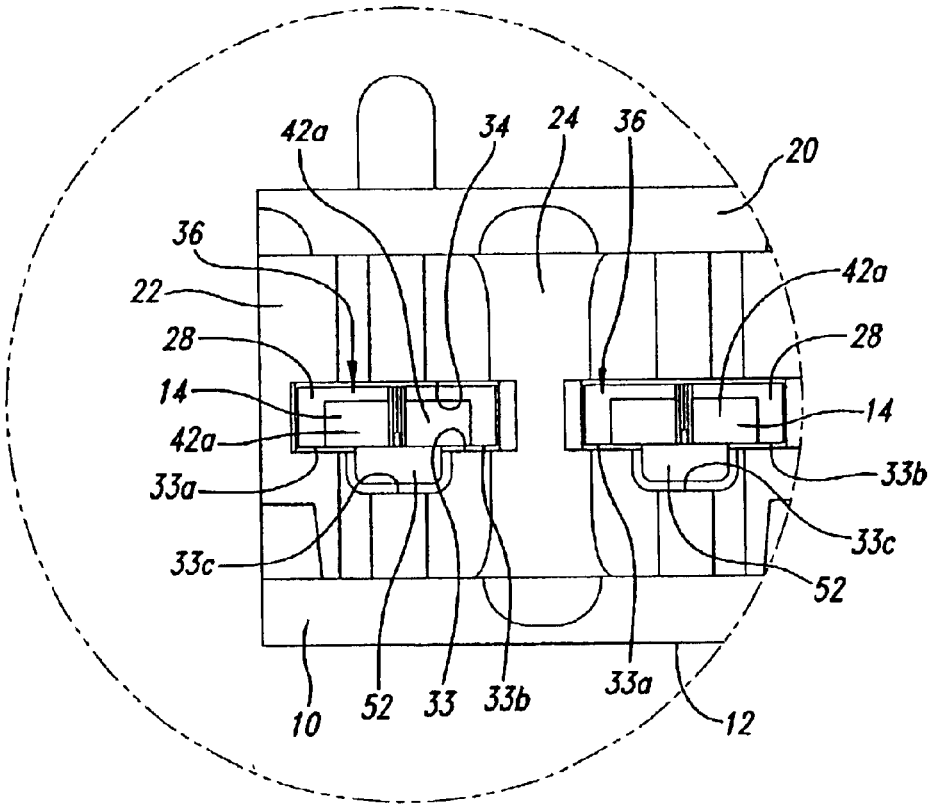
FIG. 10A is an enlarged fragmentary view of the electrical connector shown in FIG. 10.

As best seen in FIG. 10A, the front wall portion 33 includes laterally spaced apart, elongated left and right flat wall portions 33*a* and 33*b* which extend along a portion of the length of the body cavity 28 from the open insertion end 36 of the body cavity to the portion on the body cavity at which the boss 52 is located when the slotted beam contact 14 is fully inserted into the cavity. The left and right front wall portions 33*a* and 33*b* are positioned spaced away from the flat rear wall portion 34 of the body cavity 28 by about the thickness of the flat arms 42 and 48 of the slotted beam contact 14, and are arranged to slidably engage the left and right edge portions of the front face 50 of the slotted beam contact 14 as the contact is inserted into the body cavity, and when fully inserted into the body cavity, to tightly hold the contact therein between the left and right front wall portions and the rear wall portion with the flat front and rear faces 50 and 54 of the slotted beam contact in face-to-face contact with the left and right front wall portions and the rear wall portion, respectively, to inhibit forward and reward movement of the contact in the body cavity.

To prevent the boss 52 from interfering with the insertion process, the left and right front wall portions 33*a* and 33*b* are spaced apart by an amount at least as great as the width of the boss 52, and an elongated middle wall portion 33*c* of the front wall portion 33 spanning between the left and right flat wall portions 33*a* and 33*b*, is positioned spaced away from the flat rear wall portion 34 of the body cavity 28 by enough to form a channel for passage of the boss freely therethrough. This allows the slotted beam contact 14 to be freely and easily inserted into the body cavity 28 through the open insertion end 36 of the cavity without interference from the boss 52.

The front wall portion 33, extending from the portion on the body cavity 28 at which the boss 52 is located when the slotted beam contact 14 is fully inserted into the cavity to the open second end 38 of the body cavity 28, is flat and positioned spaced away from the rear wall portion 34 of the body cavity by about the thickness of the flat arms 48 of the contact to tightly hold the contact therebetween when fully inserted into the body cavity with the front wall portion and the rear wall portion in face-to-face contact with the flat front and rear faces 50 and 54 of the slotted beam contact, respectively. This thereby inhibits forward and reward movement of the contact in the body cavity.

Figure 3:
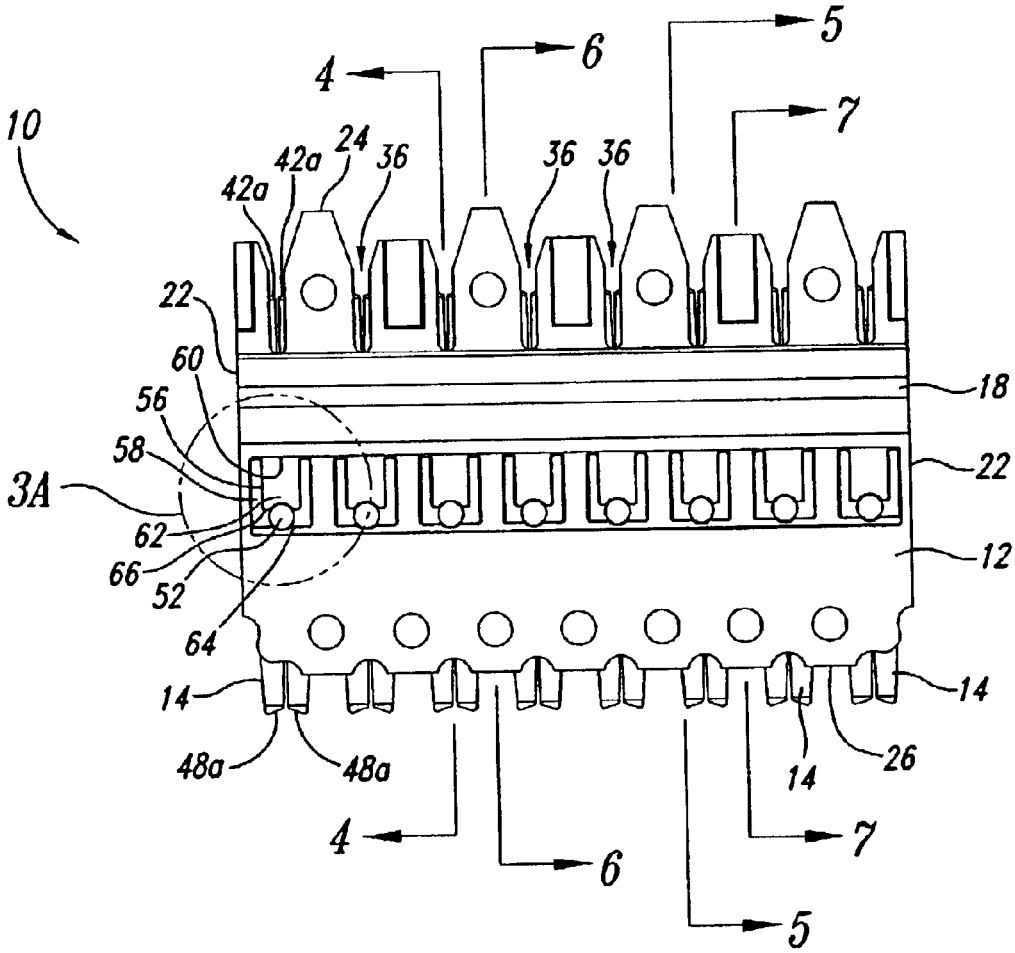
FIG. 3 is a front elevational view of the electrical connector shown in FIG. 1.
Figure 3A:
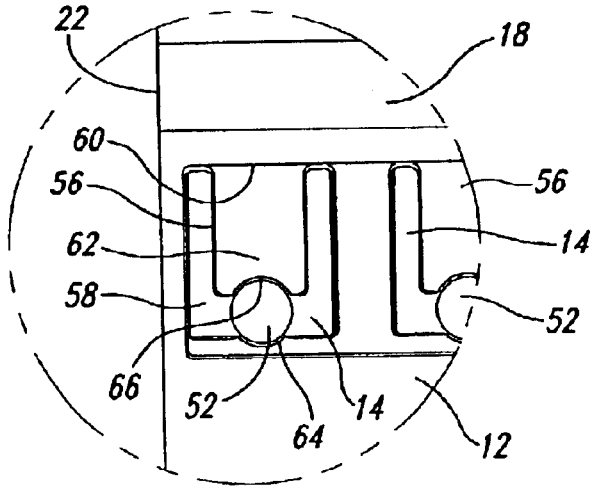
FIG. 3A is an enlarged fragmentary view of the electrical connector shown in FIG. 3.
Figure 7:
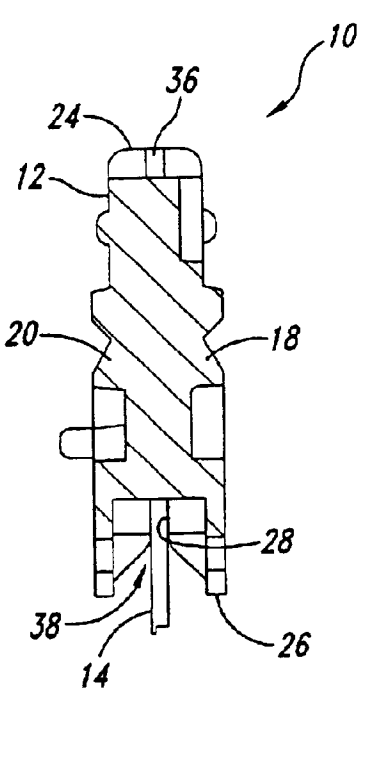
FIG. 7 is a cross-sectional view of the electrical connector taken substantially along line 7—7 of FIG. 3.
Figure 6:
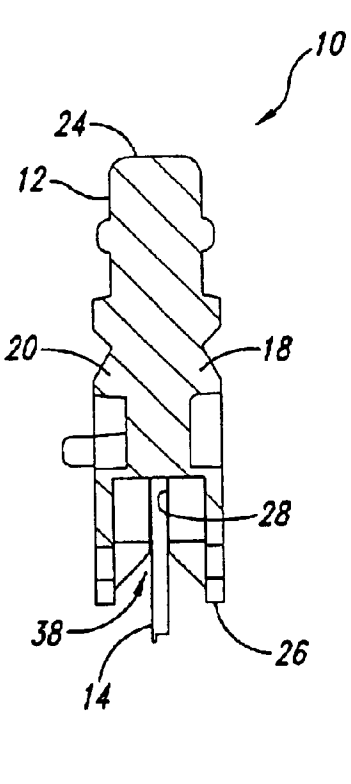
FIG. 6 is a cross-sectional view of the electrical connector taken substantially along line 6—6 of FIG. 3.
Figure 5:
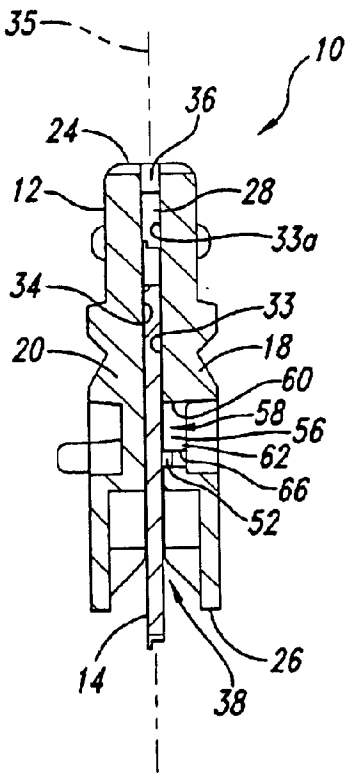
FIG. 5 is a cross-sectional view of the electrical connector taken substantially along line 5—5 of FIG. 3.

The front wall 18 of the body 12 includes eight spring arms or fingers 56, one for each of the slotted beam contacts 14 used in the connector 10. Each spring finger 56 is located in an aperture 58 in the front wall 18 of the body 12 adjacent to one of the body cavities 28 and extends in longitudinal alignment with the adjacent body cavity. The aperture 58 opens the adjacent body cavity 28. As best shown in FIG. 3A, the spring finger 56 has a proximal end portion 60 integrally formed as part of the front wall 18 of the body 12 on a side of the aperture 58 toward the open insertion first end 36 of the body cavity 28, and extends at least partially across the aperture toward an opposing side of the aperture and the open second end 38 of the body cavity and terminates in a distal free end portion 62. The proximal end portion 60 serves as a resilient hinge to permit resilient flexing of the distal end portion 62 of the spring finger away from and toward the body cavity 28 and the slotted beam contact 14 as the contact is inserted into and fully positioned within the body cavity, as will be explained in greater detail below.

An edge wall 64 of the front wall 18 of the body 12 defining the side of the aperture 58 that is opposite the side at which the proximal end portion 60 of the spring finger is attached, is positioned beyond the distal end portion 62 of the spring finger 56 by about the width of the boss 52. When the slotted beam contact 14 is fully inserted into the body cavity 28, the boss 52 projects outward, into the aperture at a location between the distal free end portion 62 of the spring finger 56 and the edge wall 64 of the body 12. The edge wall 64 serves as a stop for the boss 52 to engage the boss and thereby limit the movement of the slotted beam contact 14 in the direction toward the open second end 38 of the body cavity 28 when being inserted into the body cavity and, in conjunction with the spring finger 56, securely holds the contact in the fully inserted position within the body cavity, as will be described below.

The inward side of the spring finger 56 at the proximal end portion 60 of the spring finger, is attached to the front wall 18 of the body 12 at the end of the channel formed by the middle wall portion 33*c* of the front wall portion 33, and spaced away from the rear wall portion 34 of the body cavity 28 by the same amount as the middle wall portion. Without the slotted beam contact 14 in the body cavity 28, the inward side of the spring finger 56 slopes from the proximal end portion 60 to the distal end portion 62 inward in a direction toward the rear wall portion 34 of the body cavity 28. This places the distal end portion 62 of the spring finger 56 spaced apart from the rear wall portion 34 of the body cavity 28 by less than the thickness of the flat arms 48 of the slotted beam contact 14. With this arrangement, as the slotted beam contact 14 is inserted into the body cavity 28 through the open insertion end 36 of the cavity with the front face 50 having the boss 52 facing toward an inward side of the spring finger 56, at or about the location of the proximal end portion 60 of the spring finger 56 the boss 52 will first slidably engage the inward sloping inward side of the spring finger. As the slotted beam contact 14 is further inserted into the body cavity 28, the boss 52 will continue to slidably engage the inward sloping inward side of the spring finger 56 and cause the spring finger to progressively bend or flex in a direction away from the contact. As will be appreciated, the flat profile of the slotted beam contact 14, other than the boss 52 formed in the mid-portion 44 of the contact, facilitates its insertion into the body cavity 28.

Eventually, the continued insertion of the slotted beam contact into the body cavity 28 will result in the boss 52 passing beyond the distal end portion 62. At which time, the resiliency of the spring finger 56 causes the distal end portion 62 of the spring finger to move or snap inward toward the front face 50 of the slotted beam contact 14 to a position with an end wall 66 of the distal end portion of the spring finger in position to serve as a stop to engage the boss 52 and thereby limit movement of the contact in the direction toward the open insertion end 36 of the body cavity 28 and thus prevent removal of the contact from the cavity through the open insertion end. In the illustrated embodiment, the end wall 66 of the distal end portion 62 of the spring finger 56 has an arcuate shape generally matching the curvature of the side wall of the boss 52 to form a recess sized to receive the boss therewithin and to more securely hold the boss in place against movement, and hence the contact against planar movement. The edge wall 64 of the front wall 18 also has a recess portion with an arcuate shape generally matching the curvature of the side wall of the boss 52 to form a recess sized to receive the boss therewithin and to more securely hold the boss in place against planar movement, and hence the control against planar movement.

Preferably, when the distal end portion 62 of the spring finger 56 snaps inward, it will move sufficiently far inward to engage the front face 50 of the slotted beam contact 14 and apply a rearward force thereto tending to hold the contact against the rear wall portion 34 of the body cavity 28 and thereby reduce forward movement of contact within the contact cavity.

As previously discussed, the edge wall 64 of the front wall 18 of the body 12 defining the side of the aperture 58 opposite the side at which the proximal end portion 60 of the spring finger is attached, is positioned beyond the distal end portion 62 of the spring finger 56 by about the width of the boss 52. The edge wall 64 serves as a stop for the boss 52 to prevent the further movement of the boss, and hence the slotted beam contact 14, toward the open second end 38 of the body cavity 28. As such, when the slotted beam contact 14 has been inserted into the contact cavity 28 to where the boss 52 passes beyond the end of the distal end portion 62 of the spring finger 56, the boss will be trapped between the end wall 66 of the distal end portion and the edge wall 64 of the front wall 18, and the contact will be held securely within the contact cavity in a fully inserted position. When so positioned, the slotted beam contact 14 is held within the body cavity 28 against movement therein and unintended removal from the body cavity during the use of the connector 10.

While the proximal end portion 60 of the spring finger 56 has been described above to serve as a resilient hinge to permit resilient flexing of the distal end portion 62 thereof, the spring finger may be made to be resilient along all or a part of its length and thus flex somewhat along its length to provide at least a portion of the resilient and flexible characteristic of the spring finger described above.

By forming the spring fingers 56 integrally with the body 12, a simplified one-piece body construction is achieved and assembly of the connector 10 is significantly simplified, thus reducing the cost of manufacture. The slotted beam contacts 14 are easily inserted into the cavities 28 of the body 12 until the bosses 52 of the contacts are moved into position for the distal end portions 62 of the spring fingers 56 to resiliently move inward to retain the contacts in fully inserted positions, thus further reducing the cost of manufacture. The design of the connector 10 allows rapid automatic assembly by reducing the number of parts and processes required. Further, no use of ultrasonic welding, chemical bonding, staking of separate anchoring members or cold form bonding is required.

As noted above, the slotted beam contacts 14 are manufactured as a long leadframe with the bar 16 connecting many contacts together. As such, in actuality, assembly is accomplished by bringing the body 12 to the leadframe and aligning the eight cavities 28 of the body with eight of the slotted beam contacts 14, and then pushing the body toward the leadframe to simultaneously insert the eight contacts fully into the eight body cavities through the open insertion first ends 36 of the body and cause the eight spring fingers 56 to simultaneously snap inward as the eight bosses 52 of the contacts pass beyond the ends of the distal end portions 62 of the spring fingers and approach the edge walls 64 of the front wall 18. In such manner, the bosses 52 will be trapped between the end walls 66 of the distal end portions 62 of the spring fingers 56 and the edge wall 64 of the front wall 18. The leadframe with bodies so attached is then processed to cut the bar 16 off and leave the slotted beam contacts in the bodies and the bodies with contacts thereby separated from each other.

Figure 16:
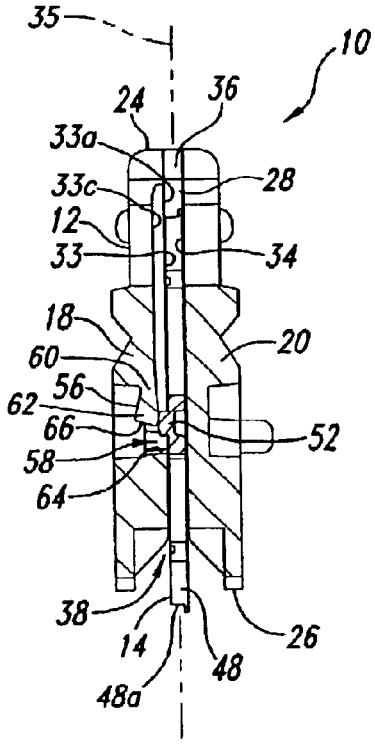
FIG. 16 is a cross-sectional view of the electrical connector of FIG. 1 similar to FIG. 4 but with the slotted beam contact shown partially inserted into a cavity of the body.

The bodies 12 is shown in FIG. 16 with one of the slotted beam contacts 14 partially inserted in one of the body cavities 28 for purposes of illustration, although upon original manufacture the contacts are attached to the bar 16 and all eight contacts are inserted simultaneously. In FIG. 16, the spring finger 56 is shown flexing outward away from the slotted beam contact 14 as it is inserted into its body cavity 28. Once the slotted beam contact 14 is sufficiently inserted to move the boss 52 past the end of the distal end portion 62 of the spring finger, the spring finger flexes inward and retains the contact securely within the body cavity with the boss trapped between the end wall 66 of the distal end portion 62 of the spring finger and the edge wall 64 of the front wall 18, nested into the curved contours of the end wall 66 and the edge wall 64, as shown in FIG. 4.

With the spring fingers 56 of the body 12 providing a snap locking means, the design and assembly of the connector 10 is simplified, yet the slotted beam contacts 14 are held securely in their respective body cavities 28. The plastic of the body 12, and hence the spring fingers 56, has sufficient resiliency and memory to allow the spring fingers to be flexed for insertion of the slotted beam contacts 14 and still return toward their original positions with a snap action and securely hold the contacts in place. The plastic is selected to provide a positive snap-in action without the plastic significantly deforming or distorting, or shearing so that the spring fingers 56 keep the slotted beam contacts securely held in their respective body cavities 28 after insertion and during use of the connector 10.

Should it be necessary to replace the body 12 of the connector 10 in the event of its damage in the field, the spring fingers 56 can be pried outward using an appropriate tool by an amount necessary so that the bosses 52 of the slotted beam contacts 14 are clear of the end walls 66 of the distal end portions 62 of the spring fingers 56 and can pass under the spring fingers to allow the contact to be moved toward the open insertion first ends 36 of the body cavities 28 and removed from the body cavities. Once the slotted beam contacts 14 are removed, the damaged body 12 can then be replaced with a new one by inserting the contacts through the open insertion first ends 36 of the body cavities 28 of the new body until they are fully inserted therein and locked in place by the spring fingers 56. Alternatively, should it be necessary to individually replace one of the slotted beam contacts 14, the spring finger 56 corresponding to the contact to be replaced can be flexed as described above to remove only that contact from the body 12. In that way, only the bad contact need be removed and replaced.

With the spring fingers 56 and aperture 58 arrangement described above, the outward end faces of the bosses 52 of the slotted beam contacts 14 when in the body 12 are unobstructed for purposes of making electrical contact therewith using a test or troubleshooting probe. In such manner, even after the connector 10 is fully assembled with the slotted beam contacts 14 retained securely within the body cavities 28, a troubleshooting probe can be used to separately contact each of the metal slotted beam contacts to verify continuity or check the electrical signal on a contact without disassembly of the connector. The boss 52 of the slotted beam contact 14 has a height such that when retained by the spring finger 56, the end wall 66 of the distal end portion 62 of the spring finger projects above the boss, as does the edge wall 64 of the front wall 18 of the body 12, to form a walled recess about and above the boss into which the tip of the troubleshooting probe can be inserted and retained against unintended lateral movement thereof. The walled recess thus helps holds the tip of the probe on location and prevents accidental electrical contact with adjacent slotted beam contacts.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An electrical connector of the type for electrically interconnecting a first set of insulated wire conductors with a second set of insulated wire conductors, the connector comprising:

a dielectric body having a plurality of contact cavities therein, each contact cavity having an open contact insertion first end, an open second end and an associated stop;

a plurality of planar slotted beam contacts, each contact sized to be inserted through the open contact insertion first end of one of the contact cavities and positioned within the contact cavity, each contact having a first end portion, a second end portion and a mid-portion therebetween, the mid-portion having an outward facing side with a protrusion projecting away from the outward side, each contact being configured such that when within one of the contact cavities the first end portion is positioned toward the open contact insertion first end of the contact cavity to displace the insulation and make electrical contact with the wire of one of the insulated wire conductors of the first set of conductors located toward the open contact insertion first end and the second end portion is positioned toward the open second end of the contact cavity to displace the insulation and make electrical contact with the wire of one of the insulated wire conductors of the second set of conductors located toward the open second end; and a plurality of resilient arms, each arm having a hinge portion attached to the body and a free end portion positioned spaced away from the stop associated with the contact cavity at which the arm is positioned by a distance sufficient to receive the protrusion of the contact positioned in the contact cavity between the free end portion of the arm and the stop, the free end portion of the arm being positioned to engage the protrusion of the contact within the contact cavity at which the arm is positioned when the contact is within the contact cavity and limit movement of the contact in a direction toward the open contact insertion first end of the contact cavity, the stop being positioned to engage the protrusion of the contact within the contact cavity with which the stop is associated when the contact is within the contact cavity and limit movement of the contact in a direction toward the open second end of the contact cavity, the hinge portion of the arm having sufficient resiliency to allow the free end portion of the arm to be resiliently moved away from the outward side of the mid-portion of the contact in the contact cavity at which the arm is positioned as the contact is inserted into the contact cavity from the open contact insertion first end thereof in response to sliding engagement of the free end portion of the arm with the protrusion of the contact and resiliently moved toward the outward side of the mid-portion of the contact when the free end portion of the arm is out of sliding engagement with the protrusion of the contact to position the free end portion to prevent removal of the contact from the contact cavity through the open contact insertion first end thereof.

2. The connector of claim 1 wherein the resiliency of the hinge portion of the arm is sufficient to allow the free end portion of the arm to be resiliently moved away from the outward side of the mid-portion of the contact to release the protrusion and allow removal of the contact from the contact cavity through the open contact insertion first end thereof after the contact is first inserted into the contact cavity.

3. The connector of claim 1 wherein the body and the arms are formed with a one-piece construction.

4. The connector of claim 1 wherein the free end portion of each arm includes an end wall positioned to engage the protrusion of the contact within the contact cavity at which the arm is positioned.

5. The connector of claim 4 wherein the end wall of the free end portion of each arm has a recess sized to receive the protrusion of the contact therewithin.

6. An electrical connector of the type for electrically interconnecting a first set of insulated wire conductors with a second set of conductors, the connector comprising:

a body having a plurality of contact cavities therein, each contact cavity having an open contact insertion end;

a plurality of insulation penetrating contacts, each contact sized to be inserted through the open contact insertion end of one of the contact cavities and positioned within the contact cavity, each contact having a first end portion and a second portion spaced away from the first end portion, the first end portion being configured to displace the insulation and make electrical contact with the wire of one of the insulated wire conductors of the first set of conductors and the second portion having a protrusion projecting outward;

a plurality of arms, each arm positioned adjacent to one of the contact cavities, each arm having an attachment portion attached to the body and a free end portion configured to engage the protrusion of the contact within the contact cavity adjacent to which the arm is positioned when the contact is within the contact cavity and limit movement of the contact in a direction toward the open contact insertion end of the contact cavity, the arm being resiliently movable away from the second portion of the contact in the contact cavity adjacent to which the arm is positioned as the contact is inserted into the contact cavity from the open contact insertion end thereof in response to sliding engagement of the free end portion with the protrusion of the contact and being resiliently movable toward the second portion of the contact when the free end portion of the arm is out of sliding engagement with the protrusion of the contact to position the free end portion to retain the contact within the contact cavity against removal through the open contact insertion end thereof; and a plurality of stops, each stop associated with one of the contact cavities and positioned spaced away from the free end portion of the arm positioned adjacent to the contact cavity by a distance sufficient to receive the protrusion therebetween, the stop being positioned to engage the protrusion of the contact within the contact cavity with which the stop is associated when the contact is within the contact cavity and limit movement of the contact in a direction away from the open contact insertion end of the contact cavity.

7. The connector of claim 6 wherein the arm is sufficiently resiliently movable to allow the free end portion to be again moved away from the second portion of the contact to release the protrusion and allow removal of the contact from the contact cavity through the open contact insertion end thereof.

8. The connector of claim 6 wherein the attachment portion of the arm provides a hinged attachment of the arm to the body and has sufficient resiliency to allow the arm to be resiliently moved away from the second portion of the contact to release the protrusion and allow movement of the contact in the direction toward the open contact insertion end and removal of the contact from the contact cavity through the open contact insertion end thereof.

9. The connector of claim 6 wherein the first end portion of the contact is positioned toward the open contact insertion end of the contact cavity when the contact is within the contact cavity.

10. The connector of claim 6 wherein the body and the arms are formed with a one-piece construction.

11. The connector of claim 6 wherein the contact cavities are arranged in a common plane, the contacts are planar with the second portion of each contact having a planar face, when the contacts are received within the contact cavities the contacts are retained in a coplanar arrangement parallel to the common plane with the planar contact faces of the contacts facing transverse to the common plane, and the free end portion of each arm is arranged for engagement with the planar contact face of the contact in the contact cavity adjacent to which the arm is positioned and the protrusion projects outward from the planar contact face toward the free end portion of the arm.

12. The connector of claim 6 wherein the contact cavities are arranged in a common plane, the second portions of the contacts each has a planar face, when the contacts are received within the contact cavities the cavities retain the planar contact faces in a coplanar arrangement parallel to the common plane with the planar contact faces facing transverse to the common plane, the protrusion projecting outward from the planar contact face outward of the common plane and the free end portion of each arm being positioned adjacent to the planar contact face of the contact in the contact cavity adjacent to which the arm is positioned.

13. The connector of claim 6 wherein the body is elongated along a longitudinal body axis and has first and second walls extending along the body axis, the first and second body walls facing in opposite first and second outward directions, respectively, transverse to the body axis, the contact cavities are positioned between the first and second body walls and arranged along the body axis, the second portions of the contacts each has a face, when the contacts are received within the contact cavities the contact faces are retained facing in the first direction and the protrusions project outward from the contact faces in the first direction, and the free end portion of each arm is positioned at the first body wall and facing in the second direction and arranged adjacent to the contact face of the contact in the contact cavity adjacent to which the arm is positioned.

14. The connector of claim 6 wherein the free end portion of each arm includes an end wall positioned to engage the protrusion of the contact within the contact cavity adjacent to which the arm is positioned.

15. The connector of claim 6 wherein the body includes a plurality of apertures having first and second opposing sides, each aperture positioned adjacent to one of the contact cavities and opening to the adjacent contact cavity, the arm positioned adjacent to the contact cavity extending at least partially across the aperture and having the attachment portion thereof attached to the body at the first aperture side and the free end portion thereof positioned toward the second aperture side, the stop associated with the contact cavity being attached to the body at the second aperture side, the protrusion of the contact within the contact cavity projecting outward into the aperture.

16. An electrical connector of the type for electrically interconnecting a first set of insulated wire conductors with a second set of conductors, the connector comprising:

a dielectric body having a plurality of contact cavities therein, each contact cavity having first and second open ends;

a plurality of insulation penetrating beam contacts, each contact being received within one of the contact cavities, each contact having a first end portion positioned at the first open end of the contact cavity and a second portion spaced away from the first end portion, the second portion of each contact having an outward projecting engagement member, the first end portion configured to displace the insulation and make electrical contact with the wire of one of the insulated wire conductors of the first set of conductors;

a plurality of spring arms, each spring arm being positioned at one of the contact cavities adjacent to the second portion of the contact received within the contact cavity, each spring arm having a resilient hinge portion attached to the body and a free end portion, the free end portion of the spring arm being in releasable engagement with the engagement member of the contact received within the contact cavity to releasably retain the contact within the contact cavity; and a plurality of stops, each stop associated with one of the contact cavities and positioned spaced away from the free end portion of the spring arm positioned at the contact cavity by a distance sufficient to receive the engagement member of the contact within the contact cavity therebetween, the stop being positioned to engage the engagement member to retain the contact within the contact cavity.

17. The connector of claim 16 wherein the contact cavities are arranged in a common plane and the spring arms are arranged for the free end portions thereof to be resiliently movable toward and away from the common plane, the engagement members of the contacts projecting outward of the common plane and toward the free end portion of the spring arm positioned at the contact cavity within which the contact is received.

18. The connector of claim 17 wherein the second portions of the contacts each has a planar face, when the contacts are received within the contact cavities the contact cavities retain the planar contact faces in a coplanar arrangement parallel to the common plane with the planar contact faces facing transverse to the common plane, the engagement member of each contact projecting outward from the planar contact face thereof.

19. The connector of claim 16 wherein the contact cavities are arranged in a common plane and the engagement members project outward of the common plane.

20. The connector of claim 16 for use when the second set of conductors are a set of insulated wire conductors, wherein each contact has a third end portion extending out of the second open end of the contact cavity within which received and configured to make electrical contact with one of the conductors of the second set of conductors, the third end portion of each contact being configured to displace the insulation and make electrical contact with the wire of one of the insulated wire conductors of the second set of conductors, the second portion of the contact being located between the first and third end portions of the contact.

21. An electrical connector of the type for electrically interconnecting a first set of insulated wire conductors with a second set of conductors, the connector comprising:

a body having a plurality of contact cavities therein, each contact cavity having an open end;

a plurality of insulation penetrating beam contacts, each contact sized to be received within one of the contact cavities through the contact cavity open end, each contact having a first end portion and a second portion spaced away from the first end portion, the first end portion configured to displace the insulation and make electrical contact with the wire of one of the insulated wire conductors of the first set of conductors, and the second portion of the contact having a protrusion;

a plurality of resilient spring arms each configured to be operable independent of the other spring arms, each spring arm positioned at one of the contact cavities adjacent to the second portion of the contact when received within the contact cavity, each spring arm having a first portion attached to the body and a resiliently movable free end second portion, the free end second portion of the spring arm being in engagement with the protrusion of the second portion of the contact when received within the contact cavity to limit movement of the contact in a direction toward the open end of the contact cavity to retain the contact within the contact cavity against removal through the open end of the contact cavity; and a plurality of stops, each stop associated with one of the contact cavities and positioned spaced away from the free end second portion of the spring arm positioned at the contact cavity by a distance sufficient to receive the protrusion of the contact within the contact cavity therebetween, the stop being positioned to engage the engagement member and limit movement of the contact in a direction away from the open end of the contact cavity to retain the contact within the contact cavity.

22. The connector of claim 21 wherein the free end second portion of the spring arm is positioned to contact and be resiliently moved in response to the free end second portion engaging the contact by an amount sufficient to permit insertion of the contact into the contact cavity through the open end of the contact cavity.

23. The connector of claim 21 wherein the free end second portion of the spring arm is positioned to be contacted by the protrusion during insertion of the contact into the contact cavity and be resiliently moved in response thereto by an amount sufficient to permit insertion of the contact into the contact cavity through the open end of the contact cavity.

24. The connector of claim 23 wherein the free end second portion of the spring arm includes an end wall positioned to engage the protrusion of the second portion of the contact within the contact cavity at which the arm is positioned, the end wall of the free end second portion of the spring arm having a recess sized to receive the protrusion of the contact therewithin.

25. The connector of claim 23 wherein the spring arm is sufficiently resiliently movable to allow the free end second portion of the spring arm to be resiliently moved by an amount sufficient to disengage the free end second portion from the protrusion to permit the removal of the contact from the contact cavity through the contact cavity open end.

26. The connector of claim 21 wherein the body includes a plurality of apertures having first and second opposing sides, each aperture positioned adjacent to one of the contact cavities and opening to the adjacent contact cavity, the spring arm positioned adjacent to the contact cavity extending at least partially across the aperture and having the first portion thereof attached to the body at the first aperture side and the free end second portion thereof positioned toward the second aperture side, the stop associated with the contact cavity being attached to the body at the second aperture side, the protrusion of the contact within the contact cavity projecting outward into the aperture.

27. The connector of claim 21 wherein the contact cavities are arranged in a common plane, the contacts are planar and each contact has a planar face, when the contacts are received within the contact cavities the contacts are retained in a coplanar arrangement parallel to the common plane with the planar contact faces of the contacts facing transverse to the common plane, and the free end second portion of the spring arm is arranged for engagement with the planar contact face of the contact within the contact cavity at which the spring arm is positioned.

28. The connector of claim 27 wherein each contact has oppositely facing first and second edge walls facing transverse to the planar contact face of the contact, and each contact is adjacent to at least one other contact cavity with adjacent contact cavities having a dividing wall therebetween with oppositely facing first and second side walls, the first side wall being positioned to engage the first edge wall of the contact in the one adjacent contact cavity and the second side wall being positioned to engage the second edge wall of the contact in the other adjacent contact cavity to assist in holding in place the contacts within the adjacent contact cavities.

29. The connector of claim 21 wherein the contact cavities are arranged in a common plane, the second portions of each contact has a planar face, when the contacts are received within the contact cavities the cavities retain the planar contact faces in a coplanar arrangement parallel to the common plane with the planar contact faces facing transverse to the common plane, the free end second portion of the spring arm being positioned adjacent to the planar contact face of the contact within the contact cavity at which the spring arm is positioned.

30. The connector of claim 29 wherein the planar contact faces of the second portions of the contacts each has the protrusion of the contact projecting out of the common plane.

31. The connector of claim 21 wherein the contact cavities are arranged in a common plane and the spring arms are arranged for the free end second portions thereof to be resiliently movable toward and away from the common plane.

32. The connector of claim 31 wherein the protrusions of the second portions of the contacts project outward of the common plane and toward the free end second portion of the spring arm positioned at the contact cavity within which the contact is received.

33. The connector of claim 21 wherein the body is elongated along a longitudinal body axis and has first and second walls extending along the body axis, the first and second body walls facing in opposite first and second outward directions, respectively, transverse to the body axis, the contact cavities are positioned between the first and second body walls and arranged along the body axis, when the contacts are received within the contact cavities the second portions of the contacts are retained facing in the first direction, the free end second portion of each spring arm is positioned at the first body wall and resiliently movable in the second direction toward and away from the second portion of the contact within the contact cavity at which the spring arm is positioned.

34. An electrical connector of the type for electrically interconnecting a first set of insulated wire conductors with a second set of conductors, the connector comprising:

a body having a plurality of contact cavities therein arranged in a common plane, each contact cavity having an open end;

a plurality of insulation penetrating beam contacts, each contact sized to be received within one of the contact cavities through the contact cavity open end, the contact cavities being configured to hold the contacts therein in the common plane, each contact having a first end portion and a second portion spaced away from the first end portion with a protrusion projecting outward of the common plane, the first end portion configured to displace the insulation and make electrical contact with the wire of one of the insulated wire conductors of the first set of conductors;

a plurality of resilient spring members, each spring member having a first portion attached to the body and a resiliently movable second portion, each spring member positioned at one of the contact cavities with the second portion adjacent to the second portion of the contact when received within the contact cavity and in engagement with the protrusion to limit movement of the contact within the contact cavity toward the contact cavity open end, the spring members being arranged for the second portions thereof to be resiliently movable away from and toward the common plane, the second portion of each spring member being resiliently movable away from the common plane when engaged by the protrusion of the contact to permit the protrusion to move therealong as the contact is moved into the contact cavity through the contact cavity open end and being resiliently movable toward the common plane after the contact is received within the contact cavity to engage the protrusion; and a plurality of stops, each stop associated with one of the contact cavities and positioned spaced away from the second portion of the spring member positioned at the contact cavity by a distance sufficient to receive the protrusion of the contact within the contact cavity therebetween, the stop being positioned to engage the protrusion and limit movement of the contact in a direction away from the contact cavity open end, whereby when the second portion of the spring member is in position to engage the protrusion with the protrusion positioned between the second portion of the spring member and the stop the contact is retained within the contact cavity against removal through the contact cavity open end.

35. The connector of claim 34 wherein the body is elongated along a longitudinal body axis and has first and second walls extending along the body axis, the first and second body walls facing in opposite first and second outward directions, respectively, transverse to the body axis, the contact cavities are positioned between the first and second body walls and arranged along the body axis, when the contacts are received within the contact cavities the second portions of the contacts are retained facing in the first direction, each spring member having the first portion attached to the body first wall and the second portion positioned at the first body wall and resiliently movable in the second direction toward and away from the second portion of the contact within the contact cavity at which the spring member is positioned.

36. The connector of claim 34 wherein the spring member second portion is sufficiently resiliently movable away from the common plane after the contact is moved into the contact cavity to disengage the spring member second portion from the protrusion to permit movement of the contact toward and the removal of the contact from the contact cavity through the contact cavity open end.

37. The connector of claim 34 wherein the body and the spring members are formed with a one-piece construction.

38. An electrical connector of the type for electrically interconnecting a first set of insulated wire conductors with a second set of conductors, the connector comprising:

a body having a plurality of contact cavities therein, each contact cavity having an open end;

a plurality of insulation penetrating beam contacts, each contact sized to be received within one of the contact cavities through the contact cavity open end, each contact having a first end portion and a second portion spaced away from the first end portion with a protrusion projecting outward, the first end portion configured to displace the insulation and make electrical contact with the wire of one of the insulated wire conductors of the first set of conductors;

a plurality of resilient spring arms, each spring arm having a first portion attached to the body and a resiliently movable second portion positioned at one of the contact cavities adjacent to the second portion of the contact received within the contact cavity, the spring arms each being configured to allow the second portion thereof to move independent of the second portion of adjacent ones of the spring arms and without interference with the simultaneous movement of the second portion of adjacent ones of the spring arms, the second portion of each spring arm being resiliently movable outward to permit the protrusion of the contact to pass therealong as the contact is moved into the contact cavity through the contact cavity open end and being resiliently movable inward in position for engagement with the protrusion after the contact is received within the contact cavity to limit movement of the contact within the contact cavity toward the contact cavity open end; and a plurality of stops, each stop associated with one of the contact cavities and positioned spaced away from the second portion of the spring arm positioned at the contact cavity by a distance sufficient to receive the protrusion of the contact within the contact cavity therebetween, the stop being positioned to engage the protrusion and limit movement of the contact in a direction away from the contact cavity open end, whereby when the second portion of the spring member is in position to engage the protrusion with the protrusion positioned between the second portion of the spring member and the stop the contact is retained within the contact cavity against removal through the contact cavity open end.

39. The connector of claim 38 wherein the spring arm second portion is sufficiently resiliently movable outward after the contact is received within the contact cavity to disengage the spring arm second portion from the protrusion to permit the removal of the contact from the contact cavity through the contact cavity open end.

40. The connector of claim 38 wherein the contact cavities are arranged in a common plane and the spring arms are arranged for the second portions thereof to be resiliently movable toward and away from the common plane.

41. An electrical connector of the type for electrically interconnecting a first set of insulated wire conductors with a second set of conductors, the connector comprising:

a body having a plurality of contact cavities therein;

a plurality of insulation penetrating beam contacts, each contact positioned within one of the contact cavities, each contact having a first end portion and a second portion spaced away from the first end portion and having an engagement member projecting outward, the first end portion configured to displace the insulation and make electrical contact with the wire of one of the insulated wire conductors of the first set of conductors;

a plurality of resilient spring arms, each spring arm having a first portion attached to the body and a resiliently movable second portion positioned at one of the contact cavities adjacent to the second portion of the contact within the contact cavity, the spring arms each being configured to allow the second portion thereof to move independent of the second portion of adjacent ones of the spring arms and without interference with the simultaneous movement of the second portion of adjacent ones of the spring arms, the second portion of each spring arm being positioned to resiliently engage the protrusion of the contact in the contact cavity at which the second portion of the spring arm is positioned to limit movement of the contact within the contact cavity in a first direction; and a plurality of stops, each stop associated with one of the contact cavities and positioned spaced away from the second portion of the spring arm positioned at the contact cavity by a distance sufficient to receive the protrusion of the contact within the contact cavity therebetween, the stop being positioned to engage the protrusion and limit movement of the contact in a second direction different from the first direction such that when the second portion of the spring member is in position to engage the protrusion with the protrusion positioned between the second portion of the spring member and the stop, the contact is retained within the contact cavity.

42. The connector of claim 41 wherein the contact cavities are arranged in a common plane and the spring arms are arranged for the second portions thereof to be resiliently movable toward and away from the common plane.

43. The connector of claim 42 wherein the protrusions project outward of the common plane and toward the second portion of the spring arm positioned at the contact cavity within which the contact is received.

44. The connector of claim 42 wherein the body is elongated along a longitudinal body axis parallel to the common plane and has first and second walls extending along the body axis, the first and second body walls facing in opposite first and second outward directions, respectively, transverse to the body axis, the contact cavities are positioned between the first and second body walls and arranged along the body axis, and hold the second portions of the contacts therein facing in the first direction, each spring arm having the first portion attached to the body first wall and the second portion positioned at the first body wall and resiliently movable in the second direction toward and away from the second portion of the contact within the contact cavity at which the second portion of the spring arm is positioned.

* * * * *